US008147281B2

(12) United States Patent
Kuwayama

(10) Patent No.: US 8,147,281 B2
(45) Date of Patent: Apr. 3, 2012

(54) CRIMP TERMINAL FOR ALUMINUM ELECTRIC CABLE

(75) Inventor: Yasumichi Kuwayama, Makinohara (JP); Goro Kuwayama, legal representative, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/933,981

(22) PCT Filed: Mar. 13, 2009

(86) PCT No.: PCT/JP2009/054947
§ 371 (c)(1),
(2), (4) Date: Jan. 21, 2011

(87) PCT Pub. No.: WO2009/119353
PCT Pub. Date: Oct. 1, 2009

(65) Prior Publication Data

US 2011/0165801 A1 Jul. 7, 2011

(30) Foreign Application Priority Data

Mar. 24, 2008 (JP) ..... 2008-075718

(51) Int. Cl.
*H01R 4/10* (2006.01)

(52) U.S. Cl. ..... 439/877

(58) Field of Classification Search ..... 439/877, 439/878, 882
See application file for complete search history.

(56) References Cited

U.S. PATENT DOCUMENTS

| | | | | |
|---|---|---|---|---|
| 3,728,787 | A * | 4/1973 | McDonough | 29/877 |
| 3,913,444 | A * | 10/1975 | Otte | 411/479 |
| 4,087,889 | A * | 5/1978 | Ohba et al. | 24/129 W |
| 5,338,233 | A | 8/1994 | Endo et al. | |
| 5,445,535 | A * | 8/1995 | Phillips et al. | 439/394 |
| 6,626,711 | B2 * | 9/2003 | Kitagawa et al. | 439/877 |
| 7,562,449 | B2 * | 7/2009 | Kuwayama et al. | 29/867 |
| 2010/0144217 | A1 * | 6/2010 | Kumakura et al. | 439/877 |

FOREIGN PATENT DOCUMENTS

| | | |
|---|---|---|
| JP | 5-84032 | 11/1993 |
| JP | 2003-249284 | 9/2003 |
| JP | 2007-173215 | 7/2007 |

* cited by examiner

*Primary Examiner* — Tulsidas C Patel
*Assistant Examiner* — Harshad Patel
(74) *Attorney, Agent, or Firm* — Finnegan, Henderson, Farabow, Garrett & Dunner, L.L.P.

(57) ABSTRACT

A crimp terminal 10 for an aluminum electric cable includes: a crimping part 12 which is connected to a core wire 21 of an aluminum electric cable 20 by crimping; and serrations 15 formed in inner surfaces 13*a*, 14*a* of this crimping part 12. In the crimp terminal 10 for an aluminum electric cable, the crimping part 12 is formed into an almost U-shape by including a base 13 and paired crimping pieces 14, 14 formed unitarily with the base 13 on two sides of the base 13; the multiple serrations 15 extending in a direction orthogonal to a lengthwise direction of the core wire 21 are continuously formed in the inner surface 13*a* of the base 13 and inner surfaces 14*a* of the respective paired crimping pieces 14, 14; and multiple serrations 16 extending in the direction orthogonal to the lengthwise direction of the core wire 21 are formed in a top end 14*c* side of an outer surface 14*b* of each of the paired crimping pieces 14, 14.

2 Claims, 3 Drawing Sheets

CRIMP TERMINAL FOR ALUMINUM ELECTRIC CABLE

TECHNICAL FIELD

The present invention relates to a crimp terminal for an aluminum electric cable which is suitable in use for connection with a thick (large-diameter) aluminum electric cable.

BACKGROUND ART

Crimp terminals for an aluminum electric cable of this type include a crimp terminal for an aluminum electric cable as shown in FIG. 1 and FIG. 2. The technique is disclosed in FIG. 1 of a Japanese Patent Application Laid-Open No. 2007-173215 (Patent Document 1). As a prior technique other than the just-mentioned technique, there exists a crimp terminal for an aluminum electric cable as shown in FIG. 7 of Japanese Patent Application Laid-Open No. 2003-249284 (Patent Document 2).

As shown in FIG. 1, this crimp terminal 1 for an aluminum electric cable includes: a fastening part 2 in which a through-hole 2*a* is formed; and a crimping part 3 in an almost U-letter shape. The through-hole 2*a* allows fastening means (not illustrated) such as a bolt to pass therethrough. The crimping part 3 is connected to a core wire 6 of an aluminum electric cable 5 by crimping. Multiple aluminum strands 6*a* are twisted together to form the core wire 6. Multiple serrations 4 are formed in an inner surface 3*a* of this crimping part 3. The serrations 4 extend in a direction orthogonal to a lengthwise direction of the core wire 6.

Once the core wire 6 of the aluminum electric cable 5 is crimped by the crimping part 3 of the crimp terminal 1 for an aluminum electric cable by pressure of squeezing as shown in FIG. 2, an oxide film of a surface of each aluminum strand 6*a* of the core wire 6 is broken by grooves of the multiple serrations 4, and a fresh surface (aluminum surface) of the aluminum strand 6*a* is exposed. Thus, the core wire 6 of the aluminum electric cable 5 is electrically connected to the crimping part 3 of the crimp terminal 1 for an aluminum electric cable.

Nevertheless, in a case where a thick (large-diameter) aluminum electric cable 5 having a larger number of aluminum strands 6*a* is connected to the conventional crimp terminal 1 for an aluminum electric cable, it is difficult to break an oxide film of a surface of an aluminum strand 6*a* situated in the core (center) of the core wire 6. Under this situation, an electric current can flow only in aluminum strands 6*a* situated in the outer side of the core wire 6, which facilitates generation of convergence resistance. This resistance causes troubles such as a rise in the temperature of the core wire 6 and failure in electric conduction thereof.

The present invention has been made to solve the problem described above. An object of the present invention is to provide a crimp terminal for an aluminum electric cable which is capable of obtaining better electric connection by securely breaking an oxide film of a surface of a core wire situated in the center portion.

DISCLOSURE OF THE INVENTION

In order to achieve the object, a first aspect of the present invention provides a crimp terminal for an aluminum electric cable, including: a crimping part which is connected to a core wire of an aluminum electric cable by crimping; and a serration formed in an inner surface of the crimping part. In the crimp terminal for an aluminum electric cable, a serration is additionally formed in an outer surface of the crimping part.

Accordingly, the first aspect of the present invention makes it possible to obtain better electrical connection by securely breaking an oxide film of a surface of the core wire situated in a center portion, because the serration is additionally formed in the outer surface of the crimping part.

The second aspect of the present invention dependent from the first aspect thereof provides the crimp terminal for an aluminum electric cable in which the crimping part is formed into an almost U-letter shape by including a base and paired crimping pieces formed on two sides of the base, the multiple serrations extending in a direction orthogonal to a lengthwise direction of the core wire are formed in an inner surface of the base and inner surfaces of the respective paired crimping pieces, and multiple serrations extending in the direction orthogonal to the lengthwise direction of the core wire are formed in at least a top end side of an outer surface of each of the paired crimping pieces.

Thus, according to the second aspect of the present invention, the crimping part is formed into the almost U-letter shape by including the base and the paired crimping pieces formed on two sides of the base, the multiple serrations extending in the direction orthogonal to the lengthwise direction of the core wire are formed in the inner surface of the base and the inner surfaces of the respective paired crimping pieces, and the multiple serrations extending in the direction orthogonal to the lengthwise direction of the core wire are formed in at least the top end side of the outer surface of each of the paired crimping pieces. Thereby, it is possible to obtain favorable electrical connection: by breaking the oxide film of the surface of the core wire situated in the outer side by ruggedness formed by the multiple serrations formed in the inner surface of the base and the inner surfaces of the respective paired crimping pieces in the crimping part; and by breaking the oxide film of the surface of the core wire situated in the center portion by ruggedness formed by the multiple serrations formed in the outer surfaces of the respective paired crimping pieces.

BEST MODE FOR CARRYING OUT THE INVENTION

Hereinblew, descriptions will be provided for an embodiment of the present invention.

Figure 1:
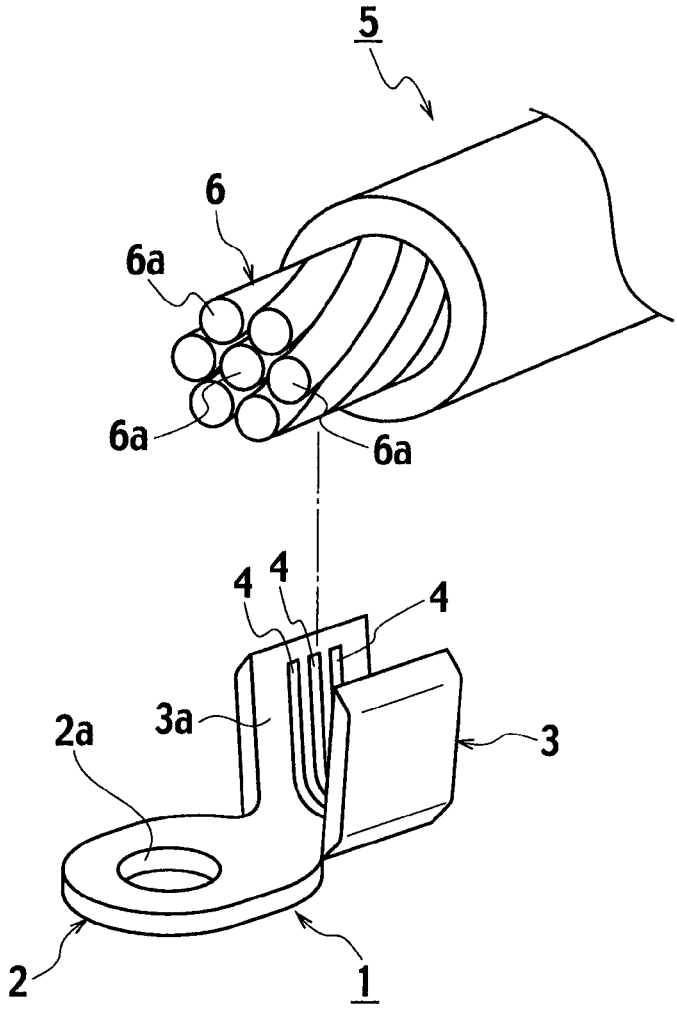
FIG. 1 is a perspective view showing a condition before a conventional crimp terminal for an aluminum electric cable crimps an aluminum electric cable.
Figure 2:
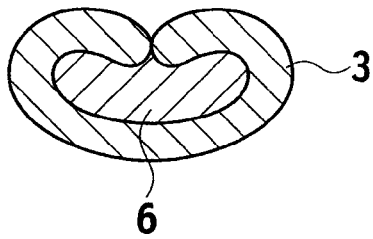
FIG. 2 is a cross-sectional view showing a condition in which the conventional crimp terminal for an aluminum electric cable crimps the aluminum electric cable.
Figure 3:
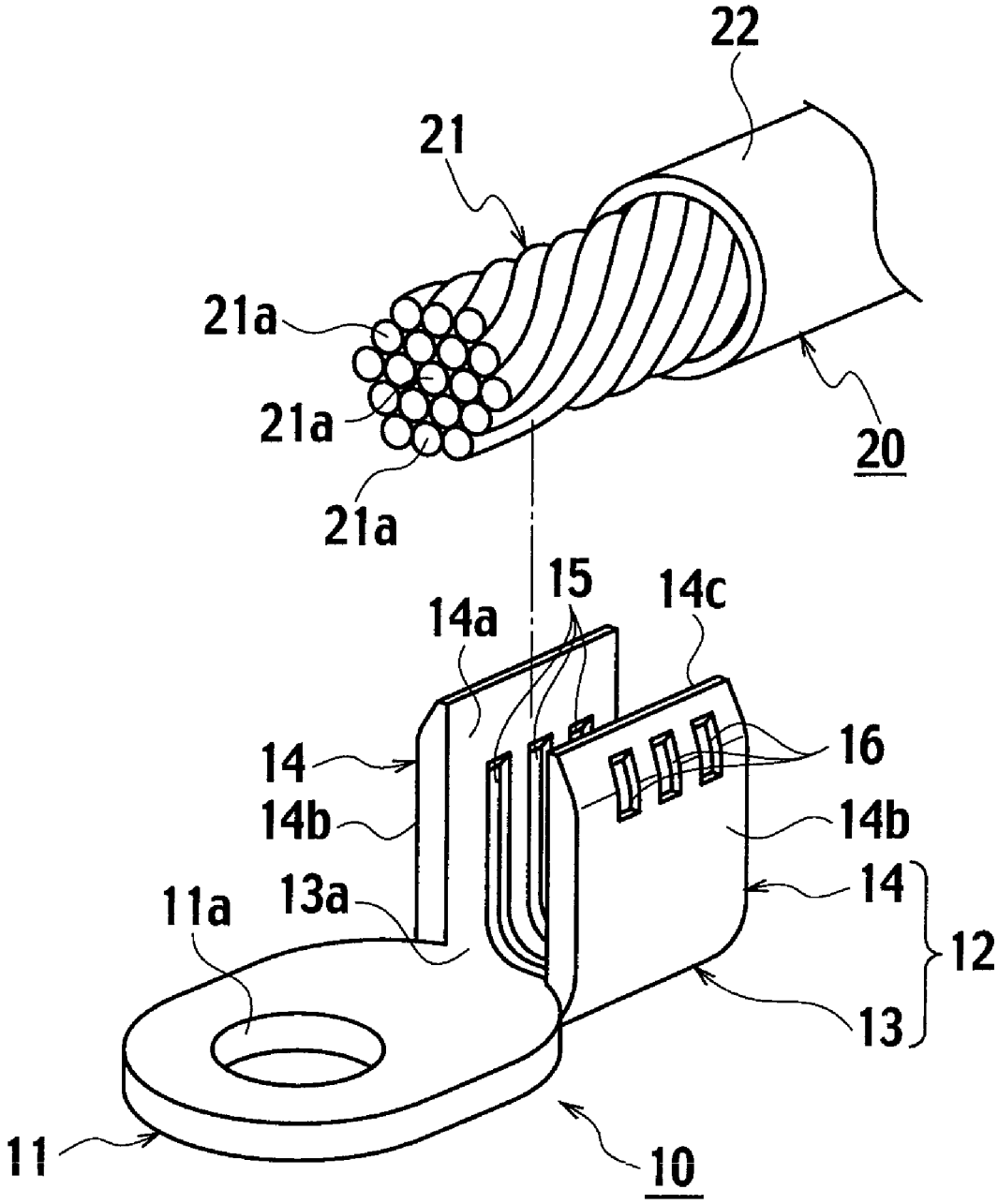
FIG. 3 is a perspective view showing a condition before a crimp terminal for an aluminum electric cable according to an embodiment of the present invention crimps an aluminum electric cable.

As shown in FIG. 3, a crimp terminal 10 for an aluminum electric cable includes: a copper-made fastening part 11 in which a through-hole 11*a* is formed; and a crimping part 12 formed unitarily with this fastening part 11. Fastening means (not illustrated) such as a bolt is capable of penetrating through the through-hole 11*a*. The crimping part 12 is connected to a core wire 21 of an aluminum electric cable 20 by crimping. Multiple aluminum strands 21*a* are twisted together to form the core wire 21. This crimping part 12 includes a base 13; and paired crimping pieces 14, 14 which are respectively formed on both left and right sides of the base 13 in a way that the paired crimping pieces 14, 14 are unitarily with the base 13. Accordingly, the crimping part 12 is in an almost U-letter shape U.

Figure 4:
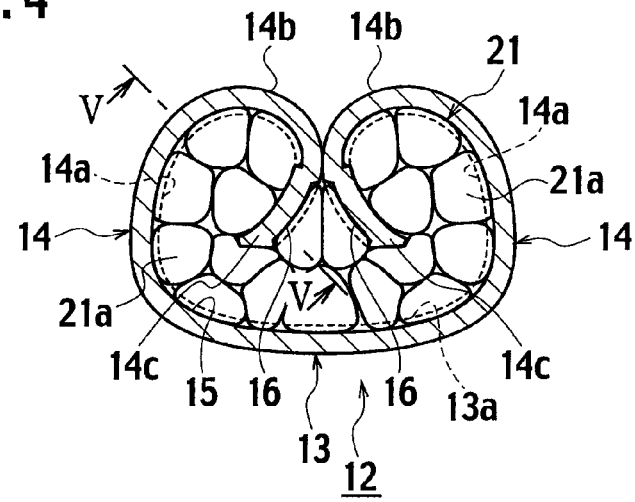
FIG. 4 is a cross-sectional view showing a condition in which the crimp terminal for an aluminum electric cable crimps the aluminum electric cable.

In addition, as shown in FIGS. 3 and 4, multiple long serrations 15 are continuously formed in an inner surface 13*a* of the base 13 and inner surfaces 14*a* of the respective paired crimping pieces 14, 14. The long serrations 15 extend in a direction orthogonal to the lengthwise direction of the core wire 21. Furthermore, multiple short serrations 16 are formed in a top end 14*c* side of an outer surface 14*b* of each of the paired crimping pieces 14, 14. The short serrations 16 extend in the direction orthogonal to the lengthwise direction of the core wire 21.

Note that, as shown in FIG. 3, the aluminum electric cable 20 is configured by including the core wire 21 and an insulating cover 22. Multiple aluminum strands 21*a* made of aluminum or an aluminum alloy are twisted together to form the core wire 21. The insulating cover 22 covers this core wire 21.

Figure 5:
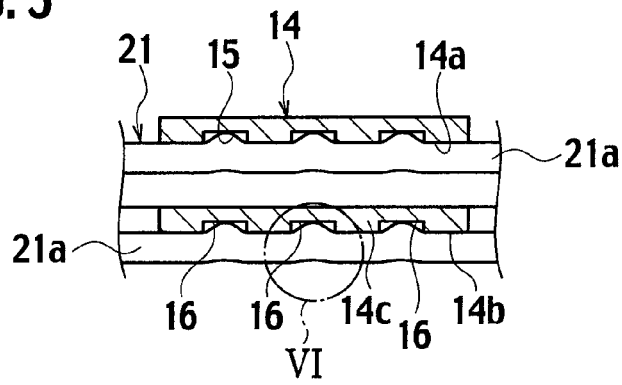
FIG. 5 is a cross-sectional view of the crimp terminal for an aluminum cable and the aluminum cable taken along the V-V line of FIG. 4.

In the crimp terminal 10 for an aluminum electric cable according to this embodiment, as shown in FIG. 4 and FIG. 5, once the paired crimping pieces 14, 14 of the crimping part 12 of the crimp terminal 10 for an aluminum electric cable crimps the core wire 21 of the aluminum electric cable 20 by squeezing the paired crimping pieces 14, 14 of the crimping part 12 in a way that the top ends 14*c* of the paired crimping pieces 14 enter the center portion of the core wire 21 of the aluminum electric cable 20, an oxide film of the surface of each of aluminum strands 6*a* situated in an outer side of the core wire 21 is broken by ruggedness which is formed by: grooves of the multiple long serrations 15 continuously formed in the inner surface 13*a* of the base 13 and the inner surfaces 14*a* of the paired crimping pieces 14, 14 in the crimping part 12; and inner surfaces 13*a*, 14*a*. Thus, fresh surfaces (aluminum surfaces) of the respective aluminum strands 6*a* are exposed. In addition, an oxide film of the surface of each of aluminum strands 21*a* situated in the center portion of the core wire 21 is broken by ruggedness which is formed by: grooves of the multiple short serrations 16 formed in the top end 14*c* sides of the outer surfaces 14*b* of the paired crimping pieces 14, 14; and the outer surfaces 14*b*. Thus, fresh surfaces (aluminum surfaces) of the respective aluminum strands 21*a* are exposed. Accordingly, the core wire 21 of the aluminum electric cable 20 is electrically connected to the crimping part 12 of the crimp terminal 10 for an aluminum electric cable in a favorable condition.

Figure 6:
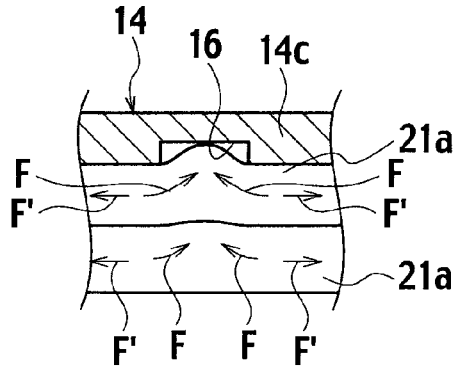
FIG. 6 is a magnified cross-sectional view of a part indicated by a circle VI in FIG. 5.

To put it specifically, when the core wire 21 of the aluminum electric cable 20 having the oxide films on the surfaces of the aluminum strands 21*a* is crimped with the copper-made crimping part 12 of the crimp terminal 10 for an aluminum electric cable, as shown in FIG. 6, the aluminum strands 21*a* situated in the center portion of the core wire 21 move (slide) as indicated by arrows F in FIG. 6 while strongly rubbed against the grooves of the serrations 16 in the outer surfaces 14*b* of the respective crimping pieces 14. Concurrently, portions of the aluminum strands 21*a* situated near serrations 16 move (slide) as indicated by arrows F' in FIG. 6, and are accordingly made to adhere to the crimping part 12 of the crimp terminal 10 for an aluminum electric cable through the rubbing. This adhesion phenomenon securely breaks the oxide films of the surfaces of the aluminum strands 21*a* situated in the center portion of the core wire 21. This causes the exposed fresh surfaces (aluminum surfaces) of the aluminum strands 21*a* and the copper-made crimping part 12 of the crimp terminal 10 for an aluminum electric cable to come into contact with each other to be conductive and adhered together, thus resulting in electrical connection therebetween. As a consequence, the electrical contact resistance of the aluminum strands 21*a* situated in the center portion of the core wire 21 which is made up of the multiple twisted aluminum strands 21*a* becomes smaller. In addition, it is possible to make an equal electric current flow in all of the aluminum strands 21*a* of the core wire 21. For this reason, even in a case where the core wire 21 of the aluminum electric cable 20 is a thick (larger-diameter) core wire, it is possible to securely reduce the temperature rise.

Furthermore, it is possible to prevent the core wire 21 of the aluminum electric cable 20 from coming off the crimping part 12 of the crimp terminal 10 for an aluminum electric cable, and accordingly to enhance the mechanical connectability.

In the foregoing embodiment, the description has been given of the case of crimping an aluminum cable having the core wire formed by twisting the multiple aluminum strands. However, note that it goes without saying that the embodiment can be applied to a case of crimping an aluminum cable having a core wire formed by bundling untwisted aluminum strands.

The present invention is not limited to what has been described above, or what has been described with respect of the embodiment of the present invention. The present invention can be carried out in various other modes by modifying the foregoing embodiment whenever deemed necessary.

Note that all of the contents of Japanese Patent Application No. 2008-075718 (filed on Mar. 24, 2008) are incorporated in this description by reference thereto.

The invention claimed is:

1. A crimp terminal for an aluminum electric cable, comprising:

a crimping part adapted for connection to a core wire of the aluminum electric cable by crimping, the crimping part comprising a base and paired crimping pieces formed on two sides of the base, wherein a first serration is formed in an inner surface of the crimping part, and a second serration is formed in an outer surface of each of the paired crimping pieces of the crimping part, the second serration being adapted to engage with the core wire of the aluminum electric cable.

2. The crimp terminal for an aluminum electric cable according to claim 1, wherein the base and paired crimping pieces form an almost U-shape;

the first serration comprising a plurality of serrations extending in a direction orthogonal to a lengthwise direction of the core wire are formed in the inner surface of the base and inner surfaces of the respective paired crimping pieces; and a plurality of second serrations extending in the direction orthogonal to the lengthwise direction of the core wire are formed in at least a top end side of the outer surface of each of the paired crimping pieces.

* * * * *